United States Patent [19]

Turek

[11] Patent Number: 4,956,902

[45] Date of Patent: Sep. 18, 1990

[54] METHOD OF PREDICTING YARN CATERPILLAR LENGTH

[75] Inventor: Douglas E. Turek, Kingston, Canada

[73] Assignee: Du Pont Canada Inc., Mississauga, Canada

[21] Appl. No.: 406,804

[22] Filed: Sep. 12, 1989

[51] Int. Cl.[5] ..... D02G 1/16

[52] U.S. Cl. ..... 28/257; 28/248

[58] Field of Search ..... 28/247, 248, 249, 254, 28/257, 258, 277

[56] References Cited

U.S. PATENT DOCUMENTS

| | | | |
|---|---|---|---|
| 3,800,374 | 4/1974 | Ozawa et al. | 28/257 |
| 3,861,133 | 1/1975 | Frankfort et al. | 28/257 X |
| 3,961,401 | 6/1976 | Ferrier et al. | 28/1.3 |
| 3,961,402 | 6/1976 | Ferrier et al. | 28/72.14 |
| 4,526,808 | 7/1985 | Strohmaier | 28/257 X |

*Primary Examiner*—Werner H. Schroeder
*Assistant Examiner*—Bradley K. DeSandro

[57] ABSTRACT

A method of predicting changes in caterpillar length of yarn. The process is used in systems wherein yarn is passed through a set of hot rollers to bulk the fibre and is then contacted with an air jet to pull the yarn away from the rollers and impinge it upon a rotating drum. This drum comprises an endless textured screen forming a cylindrical outer surface of the drum and a frame to support the screen. A caterpillar is thereby formed on the screen. Air is then exhausted from the centre of said drum to draw air through the screen and cool the yarn. The yarn is then pulled off of the screen using take-up rollers. The process for predicting a change in yarn caterpillar length comprises a step of measuring during a given time period: the change in temperature of the exhaust air (dT1), the change in temperature of the yarn (dT2) after it is taken up from the drum and the change in tension of the yarn (dF) after it is taken up from the drum. Caterpillar length change (dL) after this given period of time is then predicted using the correlation:

$$dL = \frac{a(dT1_o)}{(dL_o)}(dT1) + \frac{b(dT2_o)}{(dL_o)}(dT2) + \frac{c(dF_o)}{(dL_o)}(dF) \quad (1)$$

wherein a,b and c are weighted averages, and $a+b+c=1$; and
wherein:

$$\frac{(dT1_o)}{(dL_o)} \quad \frac{(dT2_o)}{(dL_o)} \text{ and } \frac{(dP_o)}{(dL_o)}$$

are all empirically determined constants.

3 Claims, 4 Drawing Sheets

METHOD OF PREDICTING YARN CATERPILLAR LENGTH

BACKGROUND OF THE INVENTION

This invention relates to a method of predicting yarn caterpillar length.

Yarns such as polyamide or polyester are conventionally bulked for use in carpets and other end-use applications requiring bulky fibre by passing them through a set of hot rollers. The yarn is then contacted with an air jet to pull the yarn away from the rollers and impinge it upon a rotating drum. The rotating drum comprises an endless textured screen forming a cylindrical outer surface of the drum and a frame to support the screen. The yarn forms into a "caterpillar", which is a kinked or bunched formation, as soon as it contacts the screen, because there is no tension on the yarn. Air is exhausted from the centre of the drum to draw air through the screen and cool the yarn. The yarn is allowed to remain on the drum for about one-quarter of a rotation to adequately cool the yarn and is then pulled off of the drum using take-up rollers. The caterpillar length should be fairly constant to ensure that consistent bulking properties are achieved.

The term "caterpillar length" as used herein means the length of kinked or bunched yarn contacting the drum. This parameter is directly related to the length of time the yarn remains on the drum and so may be reported in terms of either length or time. In practice, the yarn may not remain on the drum for a sufficiently long period of time and so the yarn may not be cooled sufficiently. Moreover, caterpillar length may fluctuate widely, so that consistent yarn properties are not achieved.

It is desirable to predict caterpillar length changes to monitor the bulking properties of the yarn. It is also desirable to control caterpillar length changes to obtain or maintain optimal bulking properties.

SUMMARY OF THE INVENTION

Accordingly, the invention provides a method of predicting changes in caterpillar length of yarn wherein said yarn is subject to the following processing steps:

passing yarn through a set of hot rollers to bulk the fibre;

contacting said yarn with an air jet to pull the yarn away from the rollers and impinge it upon a rotating drum comprising an endless textured screen forming a cylindrical outer surface of said drum and a frame to support said screen, thereby forming said yarn into a caterpillar on said screen;

exhausting air from the centre of said drum to draw air through said screen and cool said yarn;

pulling said yarn off of said screen using take-up rollers;

said process comprising:

measuring the change in temperature of the exhaust air (dT1), the change in temperature of the yarn (dT2) downstream from the drum and the change in tension of the yarn (dF) as it is taken up from the drum after a given period of time;

predictinq caterpillar length changes (dL) after said given period of time using the correlation:

$$dL = \frac{a(dT1_o)}{(dL_o)}(dT1) + \frac{b(dT2_o)}{(dL_o)}(dT2) + \frac{c(dF_o)}{(dL_o)}(dF) \quad (1)$$

wherein a,b and c are weighted averages, and $a+b+c=1$; and wherein:

$$\frac{(dT1_o)}{(dL_o)} \quad \frac{(dT2_o)}{(dL_o)} \text{ and } \frac{(dP_o)}{(dL_o)}$$

are all empirically determined constants.

Preferably the method further comprises the step of measuring change in package size (dP) of the package of yarn onto which said yarn is wound during said given period of time and predicting caterpillar length changes (dL) by employing the correlation:

$$dL = \frac{a(dT1_o)(dT1)}{(dL_o)} + \frac{b(dT2_o)(dT2)}{(dL_o)} + \frac{c(dF_o)(dF)}{(dL_o)} + \frac{e(dP_o)(dP)}{(dL_o)} \quad (2)$$

wherein a, b, c and e; are weighted averages, and $a+b+c+e=1$; and wherein $$\frac{(dP_o)}{(dL_o)}$$

is determined empirically.

Most preferably, the method further comprises the step of controlling the caterpillar length by adjusting a process parameter selected from: temperature of said hot rollers, exhaust rate of said exhaust air, take up roll speed or air jet pressure; when the change in caterpillar length deviates from a desired change in caterpillar length.

DESCRIPTION OF THE PREFERRED EMBODIMENTS

The invention will be further described with reference to the following drawings in which.

Figure 1:
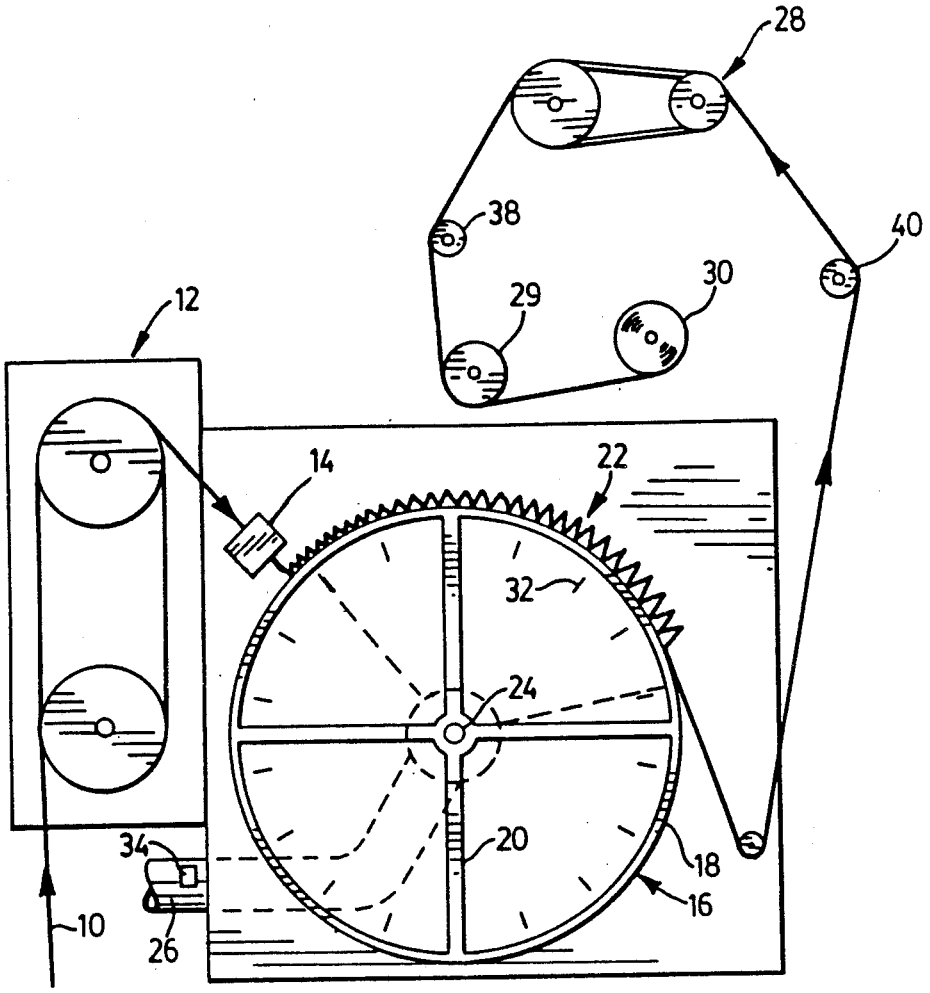
FIG. 1 is a diagrammatic illustration of apparatus for processing yarn.

A preferred embodiment of the method will be described with reference to FIG. 1. The yarn 10 is first heated by a set of heated rollers 12. It is then contacted with an air jet 14 to pull the yarn away from the rollers and impinge it upon a rotating drum 16. The rotating drum comprises an endless textured screen 18 forming a cylindrical outer surface of the drum and a frame 20 to support the screen. The yarn forms into a caterpillar 22 as soon as it contacts the screen, because there is substantially no tension on the yarn. Air is exhausted from the centre 24 of the drum through an exhaust outlet 26 to draw air through said screen and cool the yarn. The yarn is allowed to remain on the drum for about one-half of a rotation and is then pulled off of the drum using take-up rollers 28. The yarn is then directed by wind-up rollers 29 to a package 30 onto which the yarn is wound.

Caterpillar length may be affected by a number of different process parameters. If the hot rollers 12 are too hot, the yarn temperature will be higher The yarn will therefore be more easily removed from the drum 16, thus caterpillar length will be decreased. If insufficient heat is removed from the yarn when it is on the drum 16, the temperature of the exhaust air from the drum will be lower and the caterpillar will be shorter Caterpillar length is therefore inversely related to yarn temperature and is directly related to exhaust air temperature. If take-up tension of the yarn as it is pulled off of the drum is too high, caterpillar length will be decreased, so there is an inverse relationship between the two. Change in package size of the yarn as it is wound onto a package gives an indiction of the fibre bulk and so is directly proportional to the caterpillar length.

Changes in exhaust air temperature, take-up yarn tension, take-up yarn temperature and package size may therefore be related to changes in caterpillar length employing Equation 2. However, Equation 1 may give sufficiently accurate results, since package size provides complimentary information which improves the overall prediction accuracy, but is not strictly necessary to achieve meaningful results.

The first set of constants:

$$\frac{(dT1_o)}{(dL_o)} \quad \frac{(dT2_o)}{(dL_o)} \quad \frac{(dF_o)}{(dL_o)} \text{ and } \frac{(dP_o)}{(dL_o)}$$

are determined empirically. Experimentation in which the length of the yarn caterpillar is varied and the sensor responses are studied provides the data necessary to initially estimate the coefficients. Caterpillar length can be modified by numerous process changes, as previously described. A change in the speed of both the take up rollers 28 and the wind up roller 29 to vary the caterpillar length while maintaining constant wind up tension is the preferred method. Increasing the take-up roller speed will shorten the caterpillar length (i.e. move the point of transition from relaxed to tensed state closer to the air jet 14), while decreasing the take-up roller speed will allow for a longer caterpillar. Respective increases and decreases in the wind up roller speed are made to maintain a constant wind up tension.

Certain processes produce more than one threadline or package of yarn from a spinning position. In these cases separate correlations can be used to predict individual threadline caterpillar lengths, or a single model can be used to predict the average caterpillar length change Thus, the correlations of Equations (1) and (2) may be generated on the basis of individual threadline or average caterpillar length L.

The first constant is determined by carrying out experiments in which T2 (yarn take-up temperature), F (yarn take-up tension) and P (yarn package size) are held constant, L (caterpillar length) is varied by the method described above and T1 (exhaust temperature) is measured A graph of L versus T1 is then plotted from this information and the slope of the graph gives the first constant. The second constant is determined by carrying out experiments in which T1, F and P are kept constant, L is varied and T2 is measured A graph of L versus T2 is then plotted from this information and the slope of the graph gives the second constant. The third constant is determined by carrying out experiments in which T1, T2, and P are kept constant, L is varied and F is measured. A graph of L versus F is then plotted from this information and the slope of the graph gives the third constant The fourth constant is determined by carrying out experiments in which T1, T2 and F are kept constant, L is varied and P is measured. A graph of L versus P is then plotted from this information and the slope of the graph gives the fourth constant.

L may be measured from gradations 32 given on the perimeter of the drum T1 is measured by inserting a thermocouple 34 in the exhaust outlet 26. T2 is measured using a temperature sensor installed in a take-up pin 38. The sensor is a resistance temperature device located in a coaxial bore in the pin. The pin is covered with insulation having an opening therein so that the yarn may contact the pin. Take up tension is measured by a yarn tensionmeter 40 employing a strain gauge beam which bends in proportion to the yarn tension.

The second set of constants a,b,c and e are weighted averages. Preferably it is assumed that all of the parameters T1, T2, F and P are of equal importance in determining L, so $a=b=c=e=\frac{1}{4}$. Alternatively, these constants may be determined after the first set of constants have been determined by using standard linear regression techniques to improve the accuracy of prediction.

The correlation of either Equation (1) or (2) may be used either to monitor caterpillar length changes or to actually control the length changes To control the changes in length, the predicted change in length is monitored. If the predicted change in length deviates from a desired change, the temperature of the hot rollers 12, the air jet 14 pressure, the drum 16 exhaust rate, and the speed of the take-up rollers 28 may be adjusted to modify the change in caterpillar length.

The invention will be further illustrated by the following example.

EXAMPLE

The following curves were generated through experimentation in which the takeup and windup roller speeds were varied for two threadlines of 1420 decitex Nylon 6,6 yarn with water assisted caterpillar cooling on the drum. This example demonstrates the prediction of the direction and the amount of average threadline caterpillar change based on limited test data.

Figure 2:
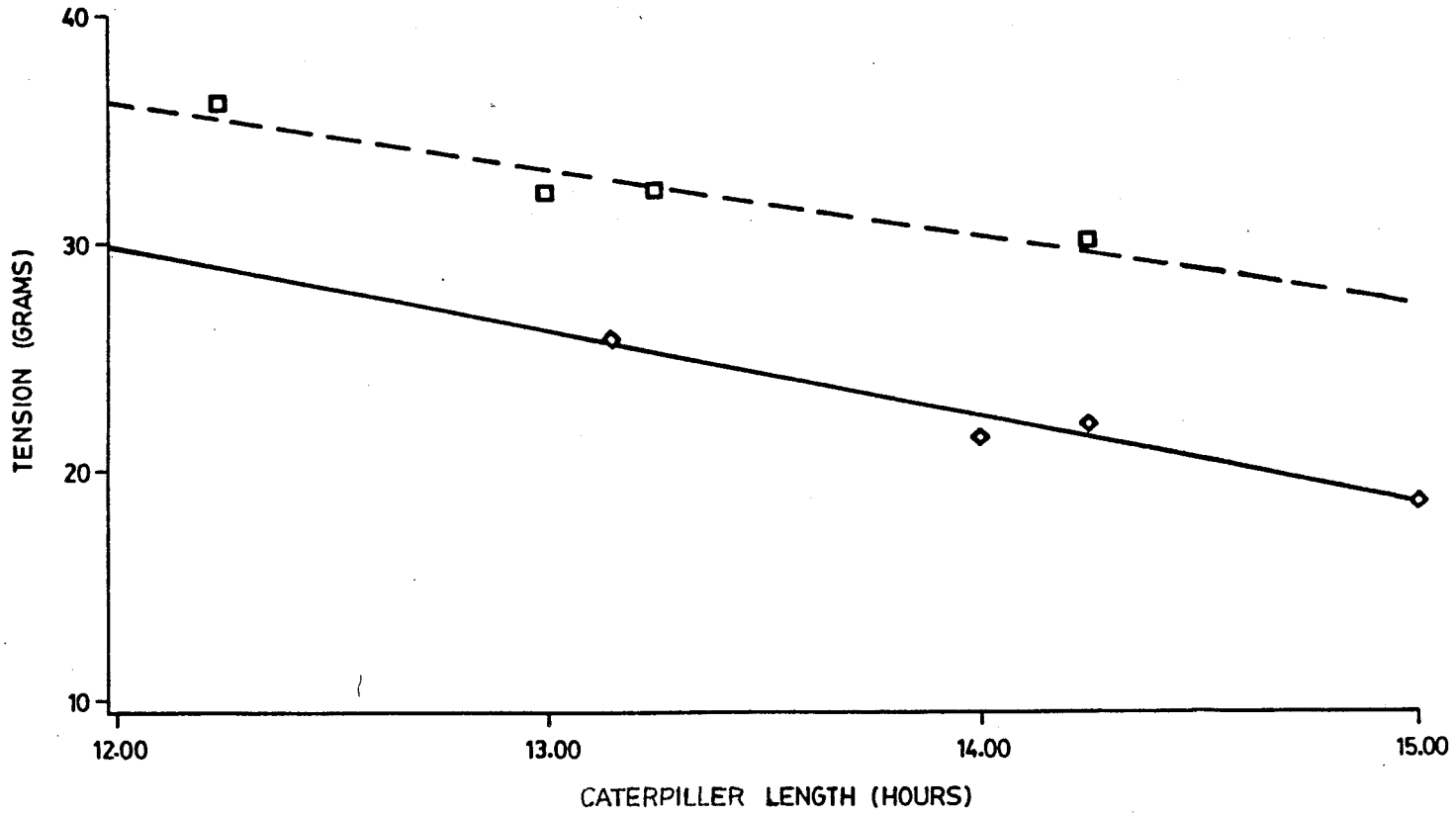
FIG. 2 is a graph of caterpillar location versus take up tension.
Figure 3:
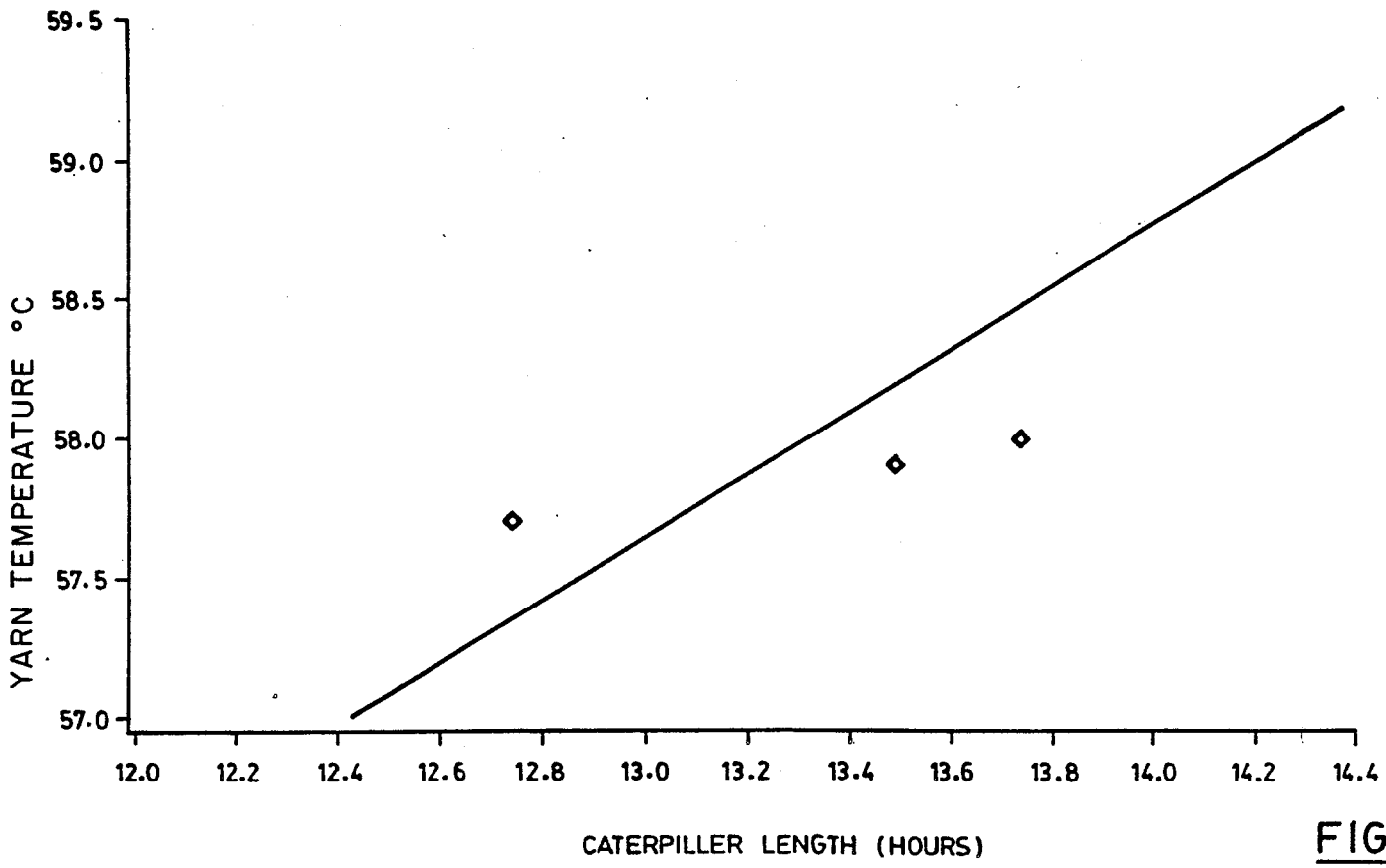
FIG. 3 is a graph of caterpillar location versus yarn temperature.
Figure 4:
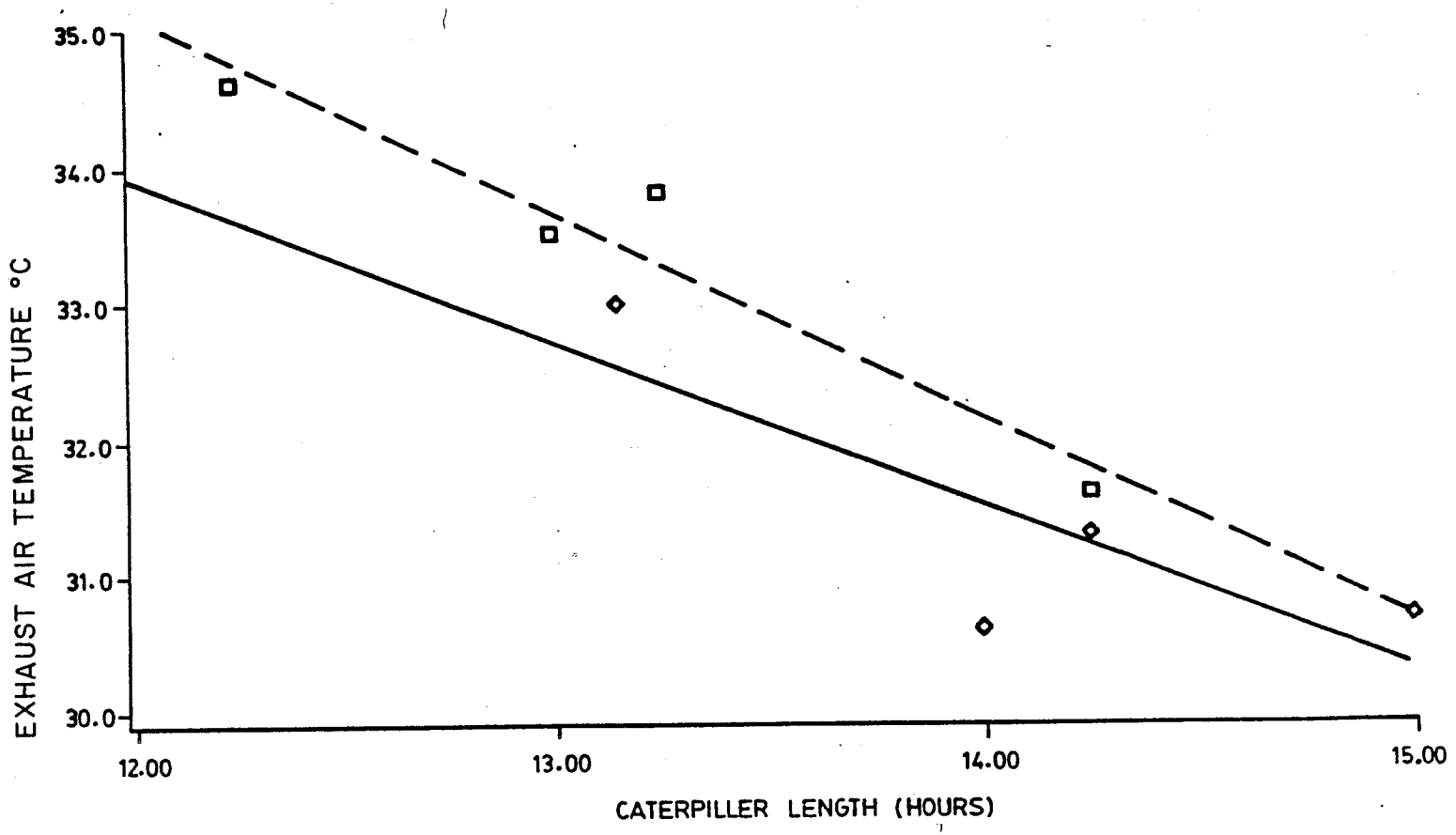
FIG. 4 is a graph of caterpillar location versus exhaust air temperature.

FIG. 2 depicts the correlation between the caterpillar length and yarn takeup tension measured for each of the left and right threadlines. The average slope of these curves is used to determine the coefficient ($dF_o/dL_o$) required to predict change in average caterpillar length FIG. 3 shows the relationship between caterpillar length and the temperature of the yarn as measured by a guide pin sensor, again plotted for each of the two threadlines. The average slope of these curves corresponds to coefficient ($dT2_o/dL_o$). Finally, FIG. 4 shows the response of the temperature of the exhaust air to changes in the average threadline caterpillar location used to determine constant ($dT1_o/dL_o$).

Caterpillar length is measured in units of hours which correspond to intervals of 15 degrees of rotation around the circumference of the bulking drum. For purposes of reference, the top of the drum is assigned the 12.00 position, the yarn first contacts the drum at the 11.00 location, and the yarn caterpillar end point, where the yarn is removed from the drum, ranges from 12.25 to 15.00 as seen on the curves. These locations are based on an analogy between the location of hours on the face of a military clock and the location of the caterpillar on the drum.

For this example, package size was assumed to be unimportant since package size measurement apparatus was unavailable. Equal weights were assumed (a,b c all equal to $\frac{1}{3}$).

The following relationship was derived:

$$dL(h) = -0.172/\text{gram}(dF) - 0.625h/°C(dT2) + 1.43\ h/°C(dT1)$$

This correlation was then compared to actual measurements for L. Table 1 below shows the prediction of a simulated shortened and lengthened caterpillar length from a reference position (control). From this table it may be seen the model correctly predicts the direction of change of caterpillar length The error in the estimate of the magnitude of change can be improved with further testing and statistical analysis of process data.

TABLE 1

| | TAKE UP TENSION(F) (gram force) | | YARN TEMPERATURE(T2) (deg celius) | | EXHAUST TEMPERATURE(T1) (deg celsius) | | dL (hour position) | |
|---|---|---|---|---|---|---|---|---|
| TEST | (avg) | (dF) | (avg) | (dT2) | (avg) | (dT1) | (expt'l) | (model) |
| control | 27.2 | — | 32.5 | — | 58.0 | — | — | — |
| short | 30.9 | 3.7 | 33.8 | 1.3 | 57.7 | −0.3 | −1.0 | −0.62 |
| long | 24.3 | −2.9 | 31.1 | −1.4 | 59.6 | 1.6 | +0.88 | +1.22 |

I claim:

1. A method of predicting changes in caterpillar length of yarn wherein said yarn is subject to the following processing steps passing yarn through a set of hot rollers to bulk the fibre;

contacting said yarn with an air jet to pull the yarn away from the hot rollers and impinge it upon a rotating drum comprising an endless textured screen forming a cylindrical outer surface of said drum and a frame to support said screen, thereby forming said yarn into a caterpillar on said screen;

exhausting air from the centre of said drum to draw air through said screen and cool said yarn;

pulling said yarn off of said screen using take-up rollers;

said process comprising:

measuring the change in temperature of the exhaust air (dT1), the change in temperature of the yarn (dT2) as it is taken up from the drum and the change in tension of the yarn (dF) as it is taken up from the drum after a given period of time;

predicting caterpillar length changes (dL) after said given period of time using the correlation:

$$dL = \frac{a(dT1_o)}{(dL_o)}(dT1) + \frac{b(dT2_o)}{(dL_o)}(dT2) + \frac{c(dF_o)}{(dL_o)}(dF) \quad (1)$$

wherein a,b and c are weighted averages, and a+b+c=1; and wherein:

$$\frac{(dT1_o)}{(dL_o)} \quad \frac{(dT2_o)}{(dL_o)} \text{ and } \frac{(dP_o)}{(dL_o)}$$

are all empirically determined constants.

2. The method of claim 1 further comprising the step of measuring change in package size (dP) of the package of yarn onto which said yarn is wound during said given period of time and predicting caterpillar length changes (dL) by employing the correlation:

$$dL = \frac{a(dT1_o)(dT1)}{(dL_o)} + \frac{b(dT2_o)(dT2)}{(dL_o)} + \frac{c(dF_o)(dF)}{(dL_o)} + \frac{e(dP_o)(dP)}{(dL_o)} \quad (2)$$

wherein a, b, c and e are weighted averages, and a+b+c+e=1; and wherein $$\frac{(dP_o)}{(dL_o)}$$

is determined empirically.

3. The method of claim 1 or 2 further comprising the step of controlling the caterpillar length by adjusting a process parameter selected from temperature of said hot rollers, exhaust rate of said exhaust air, take-up roll speed or air jet pressure, when the change in caterpillar length deviates from a desired change in caterpillar length.

* * * * *